US005638694A

United States Patent [19]

Banicevic

[11] Patent Number: 5,638,694

[45] Date of Patent: Jun. 17, 1997

[54] REFRIGERATOR ANTI SWEAT DEVICE

[76] Inventor: Nedo Banicevic, 1968 Main St. W., #608, Hamilton, Ontario L8S 1J5, Canada

[21] Appl. No.: 679,950

[22] Filed: Jul. 15, 1996

Related U.S. Application Data

[63] Continuation of Ser. No. 353,982, Jun. 12, 1994, abandoned.

[30] Foreign Application Priority Data

May 6, 1994 [CA] Canada ..... 2123029

[51] Int. Cl.[6] ..... F25B 47/00

[52] U.S. Cl. ..... 62/277

[58] Field of Search ..... 62/81, 275, 277

[56] References Cited

U.S. PATENT DOCUMENTS

| | | | |
|---|---|---|---|
| 2,135,091 | 11/1938 | Newill | 62/277 |
| 2,420,240 | 5/1947 | Haggerty | 62/277 X |
| 2,537,314 | 1/1951 | Mortensen | 62/277 |
| 3,157,306 | 11/1964 | Courson | 62/277 X |
| 3,835,660 | 9/1974 | Franck | 62/277 |
| 3,984,223 | 10/1976 | Whistler, Jr. | 62/277 X |
| 4,474,017 | 10/1984 | Prada | 62/277 X |
| 4,586,348 | 5/1986 | Nakayama et al. | 62/277 |
| 4,884,415 | 12/1989 | Mandel et al. | 62/277 |
| 5,255,531 | 10/1993 | Williams et al. | 62/277 |

*Primary Examiner*—William E. Tapolcai

[57] ABSTRACT

This invention relates to an improvement in the operation of a domestic refrigerator. The improvement comprises the addition of a mullion heater to heat an exterior surface by the passage of warm refrigerant through a tube mounted on the interior surface opposing the exterior surface. The tube is embedded in a malleable mastic substance of substantial thermal mass which is capable of maintaining the temperature of the exterior surface above the dew point of the surrounding air during periods when no warm refrigerant is passing through the tube.

4 Claims, 4 Drawing Sheets

REFRIGERATOR ANTI SWEAT DEVICE

This application is a continuation, of application Ser. No. 08/353,982, filed Jun. 12, 1994, now abandoned.

This invention relates to a device which will improve the performance of a standard two compartment domestic refrigerator. Refrigerators which house a fresh food compartment in the lower portion of the cabinet, and a food freezer compartment above the fresh food compartment may at times face the problem of moisture condensation on the surface exposed to atmosphere between the fresh food door and the freezer door during periods of time when the atmospheric temperature and humidity combine to provide the right conditions such that the exposed cabinet surface between the two doors mentioned above is at a temperature below the dew-point of the surrounding atmosphere.

In the past such problems were overcome by the inclusion of a low wattage mullion heater installed adjacent to, and in contact with the rear surface of the exposed face of the shelf formed between the two compartments (i.e. fresh food and freezer) where such face is exposed to the atmosphere between the two doors. The wattage of the mullion heater required to prevent the build up of moisture will depend on various factors, such as how the evaporator (usually located in the interior of the wall dividing the two compartments (i.e. shelf) removes heat from its surroundings, including the heat removal of the particular area of the shelf exposed to atmosphere between the two doors. If the evaporator is mounted within the shelf, and is insulated with an insulation, past practice dictates that a low wattage electric (mullion) heater would be mounted against the rear surface of the exposed area of the shelf.

In order to improve the performance and ultimately the efficiency of such a refrigerator-freezer, designers have turned away from the use of low wattage electrical (mullion) heaters and replaced them with tubing carrying warm refrigerant, and this invention relates to the use of such a solution. It was found that a metallic tube carrying such warmed refrigerant could indeed function as a mullion heater to prevent moisture accumulation on the exposed face of the shelf during most atmospheric conditions, but under some unusual conditions, moisture accumulation continued to be a problem on the exposed surface of the shelf.

These conditions tended to occur when the ambient (atmosphere) was cool, i.e. about 70° F. with the dew-point of the surrounding atmosphere was about 65° F.

Moisture accumulation in this area, i.e. the exposed surface of the shelf between the doors, was thought to be most problematic in high temperature, high humidity conditions. Such was not the case. It appears that in high temperature conditions, the compressor operates at frequent intervals, keeping the exposed temperature of the exposed face of the shelf above the dew-point. When the ambient temperature is lower, the time between periods of operation of the compressor increases, and the heat present in the tube carrying the warm refrigerant is gradually dissipated in the fresh food and freezer compartments and the temperature of the exposed surface of the shelf drops below the dew-point of the surrounding atmosphere, and hence the accumulation of moisture on the exposed face of the shelf.

To overcome the problem, it will be seen that the addition of a thermal mass to the area where the tube carrying warm refrigerant is abutted against the rear surface of the exposed front face of the shelf will overcome the problem.

SUMMARY OF THE INVENTION

This invention seeks to improve the efficiency of a domestic refrigerator by means of replacement of an electrical resistance (mullion) heater with a tube carrying warm refrigerant to maintain an exterior surface which is prone to moisture build up, essentially moisture free. The refrigerant tube is mounted in such a manner as to be abutted against the rear of the exposed surface in a bed of material having substantial thermal mass such as a loaded commercial silicone material or a commonly used sealant, butyl polybutadalene, butyl rubber, or any similar material of a mastic nature which conforms to the shape of the tube and adheres to the rear surface of the shelf face and which is able to accumulate heat when subjected to heating and release heat when subjected to conditions where the surrounding ambient temperature is lowered.

DESCRIPTION OF PREFERRED EMBODIMENT

Figure 1:
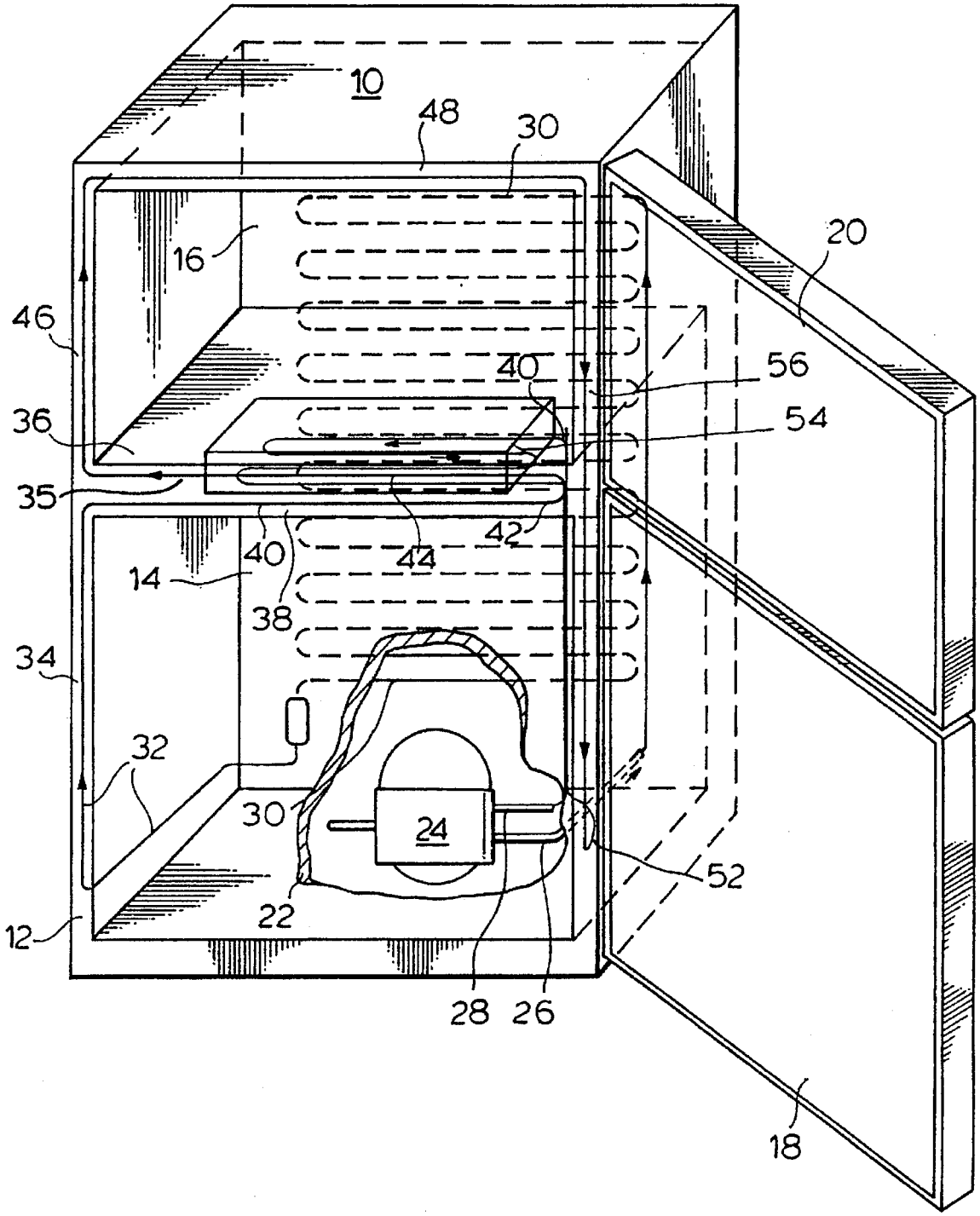
FIG. 1 is a perspective view of a domestic refrigerator showing the invention.
Figure 2:
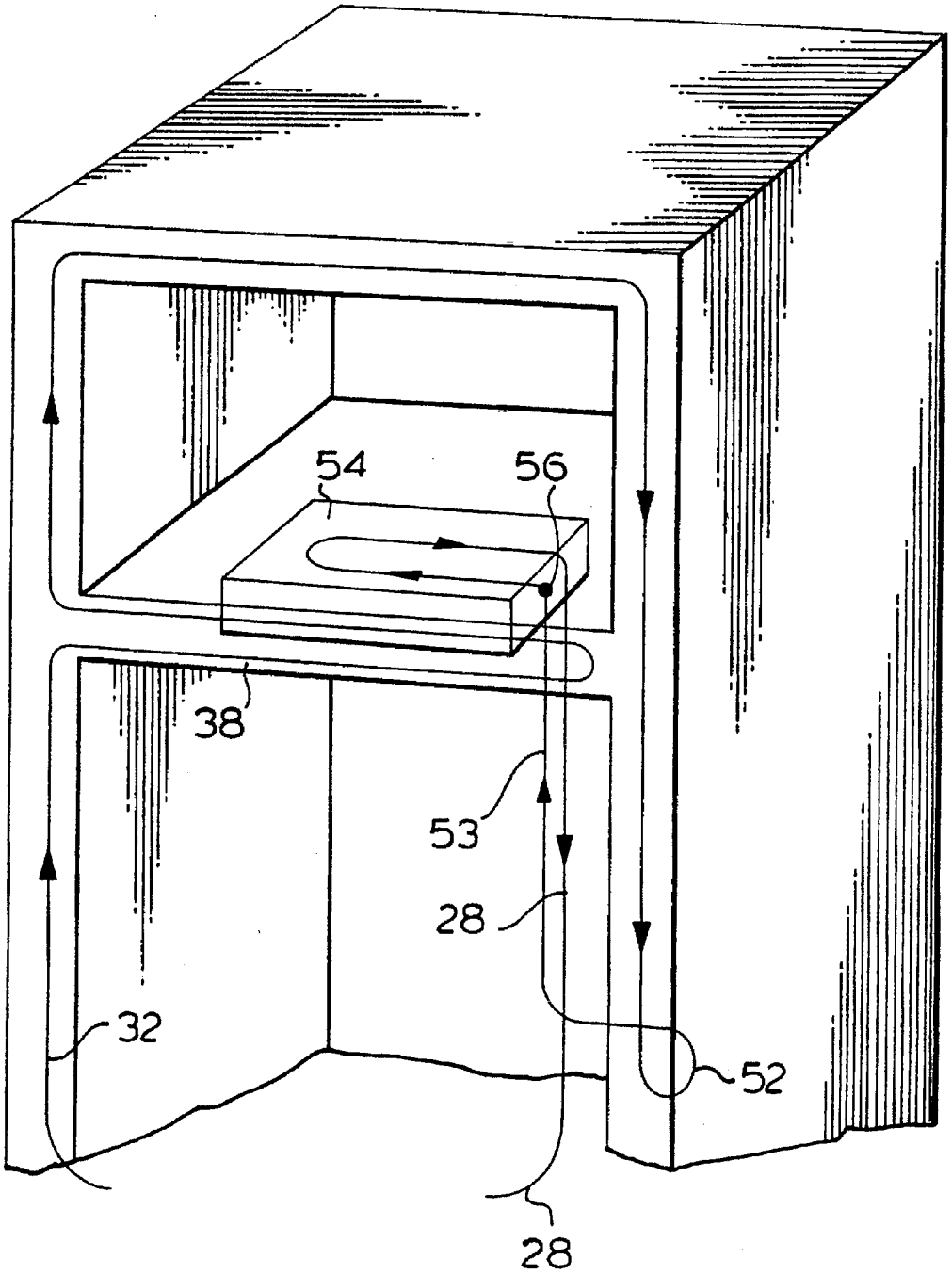
FIG. 2 is a schematic illustration of the evaporator-refrigerant circulation system of the refrigerator of FIG. 1.

Referring now to FIGS. 1 and 2 where a domestic refrigerator is shown which shows a combination refrigerator-freezer of the type where the evaporator is incorporated in the wall separating the two compartments.

Refrigerator 10 is shown having a cabinet 12 which houses a fresh food compartment 14 and a freezer compartment 16. The cabinet 12 supports two doors 18 and 20 which are hingedly supported on the cabinet, such that door 18 closes the fresh food compartment and door 20 closes the freezer compartment.

In the bottom of cabinet 12 and separated by an insulating wall 22 is a compressor 24. Compressor 24 is a standard electrical motor driven compressor which is used to compress the refrigerant used as a working fluid in the refrigerator.

Compressor 24 is shown having a compressed refrigerant line 26 and a suction line 28 connected thereto. Line 26 is wound in a serpentine 30 and is fastened to the outside of the rear wall of the refrigerator 10 to dissipate most of the heat developed in the refrigerant during the compression cycle. The serpentine 30 is then connected to a tube of reduced diameter shown as 32, and this tube is mounted on the rear surface of the surfaces of the refrigerator and shelf against which the doors 18 and 20 abut when closed. Tube 32 thus passes up the surface 34 (in the interior of cabinet 12) and across the rear surface of the front of shelf 36 at face 38 at position 40, and returns at 42 across the rear surface of the front face 38 of the shelf at position 44 slightly above the position 40. Tube 32 thence passes up the surface 46 across surface 48, and down surface 50 on the interior of the cabinet 12 to function as a mullion heater for these surfaces. At 52, the tube 32 is led up to evaporator 54 which is located in the interior of the shelf 36. Tube 32 is connected to a capillary tube 52 which feeds evaporator 54. Tube 28 returns the refrigerant from evaporator 54 to compressor 24.

Figure 3:
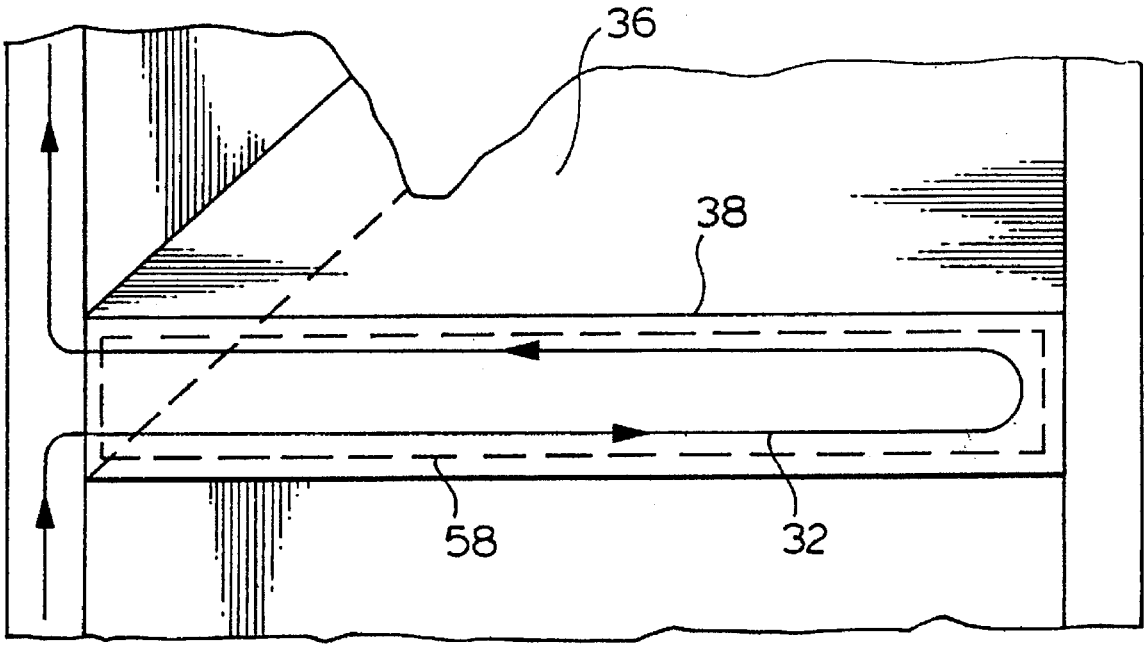
FIG. 3 is an enlarged view of the front surface of the shelf of the refrigerator of FIG. 1.

Referring now to FIG. 3 which illustrates an enlarged section of the front portion of shelf 36, it will be seen that tube 32 is mounted so as to abut the rear surface of the front face of shelf 36 and a material of a mastic nature having a good thermal mass (i.e. the ability to store and deliver substantial amounts of heat) such as butyl rubber, is applied to bed tube 32 to the interior opposing surface of the exposed front face 38 of shelf 36. The thermal material is shown at 58.

Figure 4:
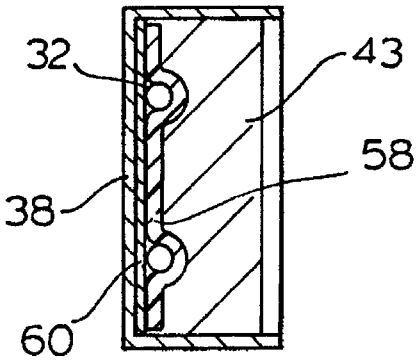
FIG. 4 is a cross sectional view of the front face of the shelf.

FIG. 4 shows the cross section of the front of shelf 36. The thermal mass material 58 is applied directly to tube 32 and to the rear surface of shelf 36. Alternately the thermal mass may be applied to tube 32 which is ultimately in good thermal contact with a conductive strip 60 which is in good thermal conductivity with the rear surface of front face 38 of shelf 36. Member 60 usually takes the form of a strip of aluminum foil, the purpose of which is to dissipate the heat from tube 32 more evenly across the rear of face 38. The space behind tube 32, and thermal mass 58 is filled with insulation 43.

Thus the presence of the thermal mass 58, tube 32 and foil 60 provides an excellent unitary body having substantial thermal mass is in excellent heat transfer relationship with front surface 38 of shelf 36.

It has been found that during most operational periods of the refrigerator, that tube 32 contains sufficient heat energy to keep surface 38 clear of moisture (if the compressor runs frequently enough).

During periods of infrequent compressor operation, it has been found that there is insufficient heat storage capacity in tube 32 alone to prevent the accumulation of moisture on surface 38 of shelf 36. The exposed surface 38 experiences a temperature drop to a point below the dew-point of the surrounding atmosphere. The addition of thermal mass 58 to the tube-shelf interface has successfully solved the problem of temperature dip below the dew point of the surrounding atmosphere between operating periods of the compressor for the exposed surface 38 of the shelf 36.

Because refrigerant (which is still warm) is used in place of prior art mullion type electrical heaters in the rear of the exposed shelf front surface as has been common practice in prior art refrigerators, the efficiency of the refrigerator has undergone an improvement.

Figure 5:
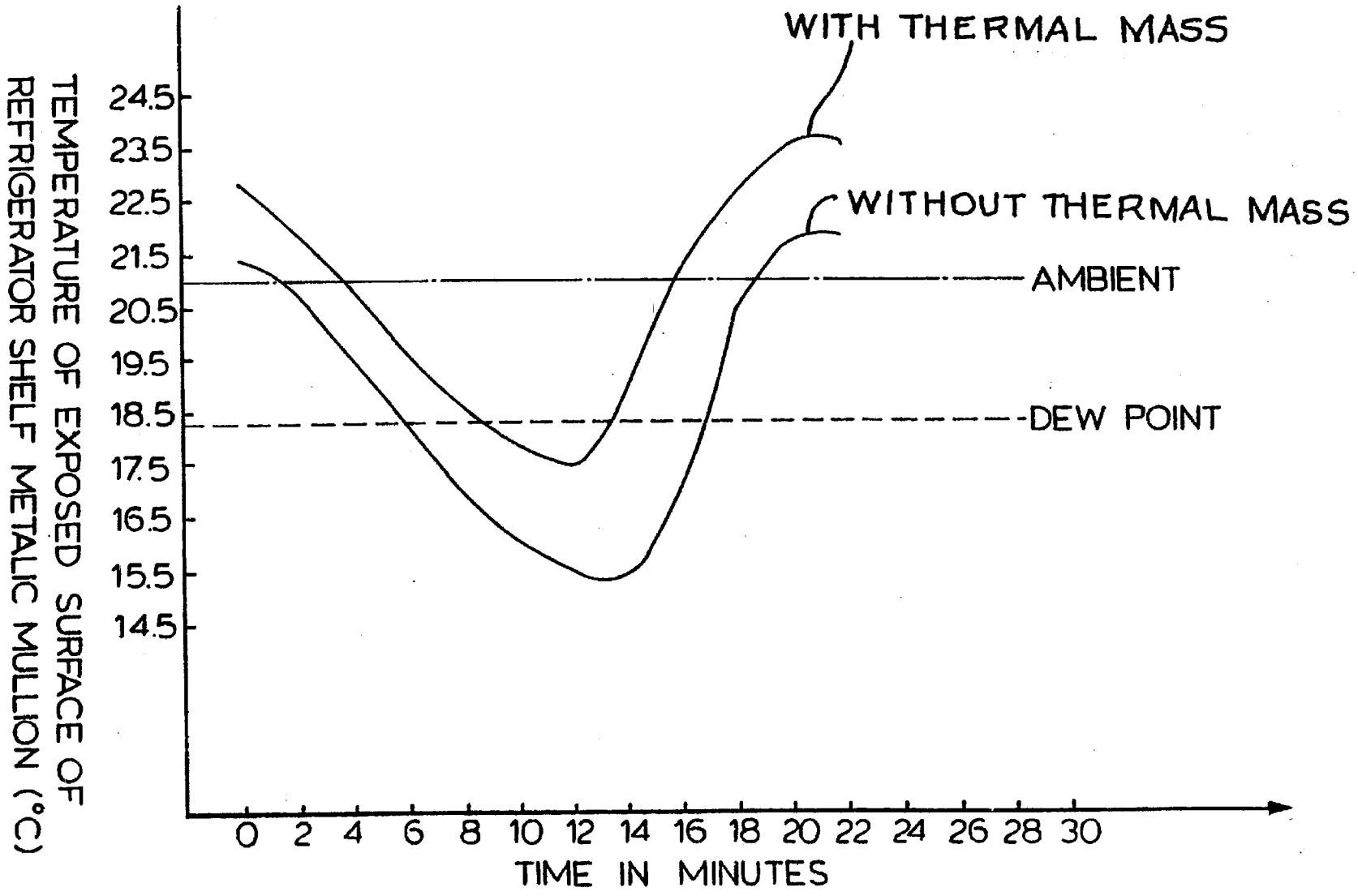
FIG. 5 is a graph showing the effect of the addition of a thermal mass of the anti condensation tube.

FIG. 5 shows an actual experimental graph of the temperature excursion of the front face 38 of the shelf 36 for a domestic refrigerator operating in an ambient of 21.1° C. (70° F.) where the dew-point temperature of the surrounding atmosphere is 18.3° C. (65° F).

Graph "A" shows the temperature excursion of the front face 38 in the absence of a thermal mass 58; graph "B" shows the improvement in the temperature excursion with the addition of suitable thermal mass material 58. Thus, with only the addition of the thermal mass 58, it is possible to shift the temperature excursion in such a manner that the buildup of moisture on surface 38 is no longer problematic.

Thus, it will be seen that it is possible to replace an electric mullion heater (which delivers constant heat to surface 38) with a heater which utilizes heat produced in the compression of refrigerant to maintain surfaces prone to the accumulation of moisture, moisture free, even though the heat energy delivered to the surface prone to moisture accumulation is delivered in pulses.

It will be obvious to those familiar with the refrigeration art that substances other than those named here will perform the function of heat storage capability which will perform satisfactorily in a domestic refrigerator to accomplish the desired result, however, applicant prefers to have coverage of the invention only limited by the following claims.

I claim:

1. An improved mullion heater for heating an exposed exterior surface of a wall of a refrigerator to prevent accumulation of condensation on said exposed exterior surface during periods of operation of said refrigerator, said mullion heater comprising a hollow metallic tube carrying warm refrigerant produced during periods when the compressor in said refrigerator is operating, said tube being mounted adjacent to, and in heat transfer relationship with an interior surface of said wall on a side opposite to said exposed exterior surface, said tube being embedded in a material of predetermined thermal mass, and a sheet of metallic material positioned flat on said interior surface, said sheet of metallic material being sandwiched between said wall and said tube and said material of predetermined thermal mass in contacting and heat transfer relationship therewith to evenly dissipate heat from the tube and said material of predetermined thermal mass across said internal surface of said wall through said wall and to said exterior exposed surface.

2. A domestic refrigerator having a cabinet wall against which a door abuts, the cabinet wall having an exposed exterior surface prone to accumulation of moisture from the surrounding atmosphere, a mullion heater to be attached to an interior surface of said cabinet wall opposing said exposed exterior surface for the addition of heat to said exposed exterior surface to prevent the accumulation of moisture on said exposed exterior surface, said mullion heater comprising:

a sheet of heat conductive material positioned flat against the interior surface of said cabinet wall adjacent to said exposed exterior surface so as to evenly dissipate heat across the metal sheet through said cabinet wall to said exposed exterior surface;

a tube mounted in close juxtapostion against said metallic sheet throughwhich warm refrigerant flows periodically to transfer heat through the metallic sheet, through said cabinet wall to said exposed exterior surface; and, a material of substantial thermal mass of a mastic material applied to said tube and overlying said metallic sheet to store heat adjacent said interior surface of said cabinet during periods when warm refrigerant does not flow through said tube.

3. A domestic refrigerator as claimed in claim 2 wherein said mastic material is one selected from the group consisting of a silicone material, a butyl polybuadalene, and a butyl rubber.

4. A domestic refrigerator as claimed in claim 2 wherein the metallic sheet comprises an aluminum foil.

* * * * *